US005152396A

United States Patent [19]

Chen et al.

[11] Patent Number: 5,152,396

[45] Date of Patent: Oct. 6, 1992

[54] ASSEMBLY TYPE PACKING DEVICE FOR DECORATION LIGHT STRING

[76] Inventors: Jen H. Chen, No. 15, Lane 167 Tung Nan Street; Jeou N. Tzeng, No. 52-1, Alley 100, Lane 311 Nan Yea Street; Jeng-Shyong Wu, Fl. 4, No. 5 Hsing Shyue Road, all of Hsin-Chu City, Taiwan

[21] Appl. No.: 659,608

[22] Filed: Feb. 21, 1991

[51] Int. Cl.[5] ..... B65D 85/42

[52] U.S. Cl. ..... 206/419; 206/421; 206/420

[58] Field of Search ..... 206/418, 419, 420, 421

[56] References Cited

U.S. PATENT DOCUMENTS 4,228,896 10/1980 Wu ..... 206/420
4,971,200 11/1990 Huang et al. ..... 206/420
5,033,619 7/1991 Garis ..... 206/420

*Primary Examiner*—William I. Price
*Attorney, Agent, or Firm*—James A. Drobile; Robert E. Rosenthal

[57] ABSTRACT

Assembly type packing device for decoration light strings comprises clamp structures for holding the lamp(s) or light(s), rack structures for supporting clamped lights; and linkage structures for linking together the rack structures into a package form. Optionally a base structure is provided to help maintain the racks erect so that a compact and orderly package for decoration light strings is achieved to facilitate storage, shipment and/or display.

16 Claims, 20 Drawing Sheets

ASSEMBLY TYPE PACKING DEVICE FOR DECORATION LIGHT STRING

The present invention relates generally to packing devices and more particularly to an assembly type packing device for decoration light strings to provide a compact and orderly package of such items as Christmas light strings to facilitate storage, shipment and/or display.

The conventional packages of decoration lights are usually provided in a ready made piece that is intended to hold a given number of lights contained in a string and is not adaptable for use in strings of variable numbers of lights. In other words, such packages lack versatility. When the use of string of varying lengths is desired, a package of varying capacity is required. So far as stocks of packing material is concerned, a warehouse has to carry packages of different dimensions depending on how many lights are to be packed in a single package of string. Hence, a big inventory is uneconomical and increases costs.

Therefore the main object of the present invention is to provide an assembly type packing device adapted to be used for strings of various lengths and characterized in that the packing device is designed to be dismantled into structural elements including clamping means, rack means, linkage means and optional base means, etc. Through a suitable combination of elements, a great deal of variation can be achieved.

Other features and objects of the present invention will become apparent from the following detailed description by way of embodiment accompanied with annexed drawings.

Before describing the details, the structure of the packing device is generically described as follows. Generally speaking, the light bulbs used in decoration strings may be categorized as relatively small size ones which are usually ganged into a series of sometimes up to one hundred in number, and relatively larger ones which are usually provided individually with hooks to be hung. However, in this invention, a package is provided for both categories through assembling by clamping individual light bulbs in clamping means, which are disposed on a rack. Linkage means are provided for assembling a plurality of racks into a package.

In the annexed drawings, FIGS. 1 to 3 illustrate linkage means; FIGS. 4 to 8, the rack means; FIGS. 9 and 10, the clamping means; FIG. 11, one of the optional bases, and FIGS. 13 to 17, various assemblages.

A brief description of drawings is now provided:

FIG. 2 depicts a beam type linkage means, wherein

FIG. 9 are plan views showing a continuous row of different types of clamping means, in which

FIGS. 10A and 10B depict a plate type clamp means, of which FIG. 10A is a bottom view, and FIG. 10B, a top view;

FIG. 11A and 11B depict a plain type vase, of which FIG. 11A is a front elevation, and FIG. 11B, a bottom view;

A component list is hereunder provided to facilitate reference during the detailed description of the preferred embodiment.

Figure 1:
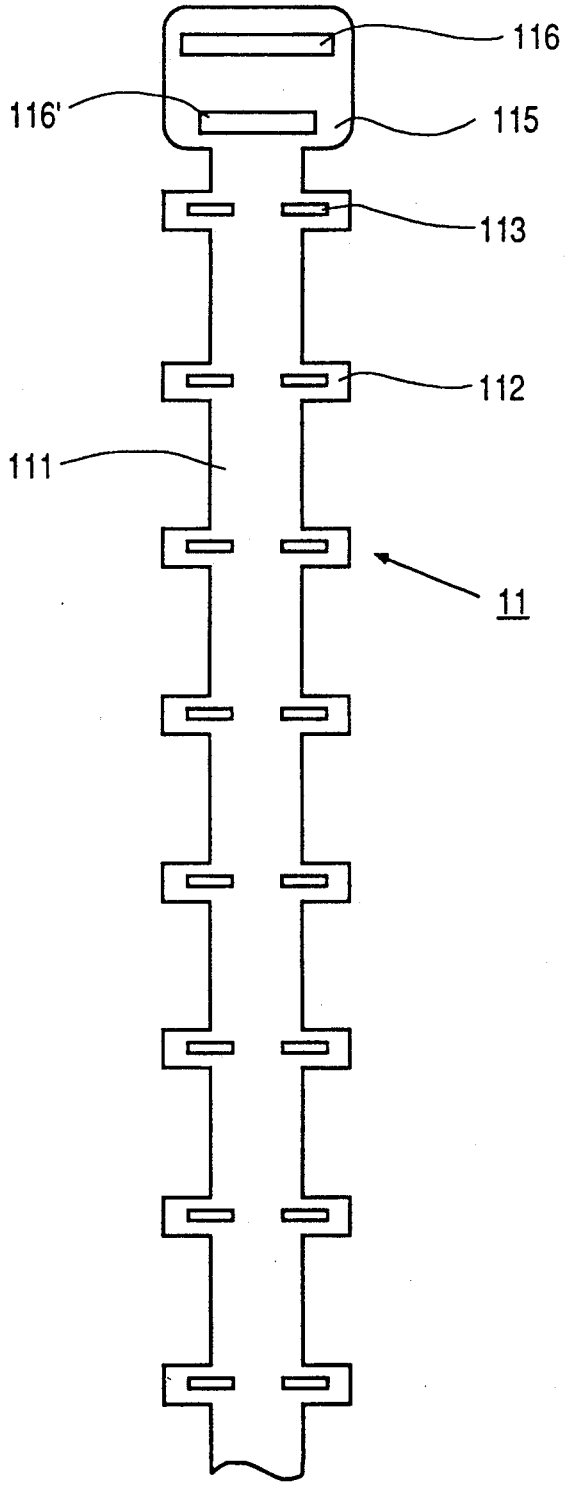
FIG. 1 is a plan view of a stripe type linkage means.
Figure 2A:
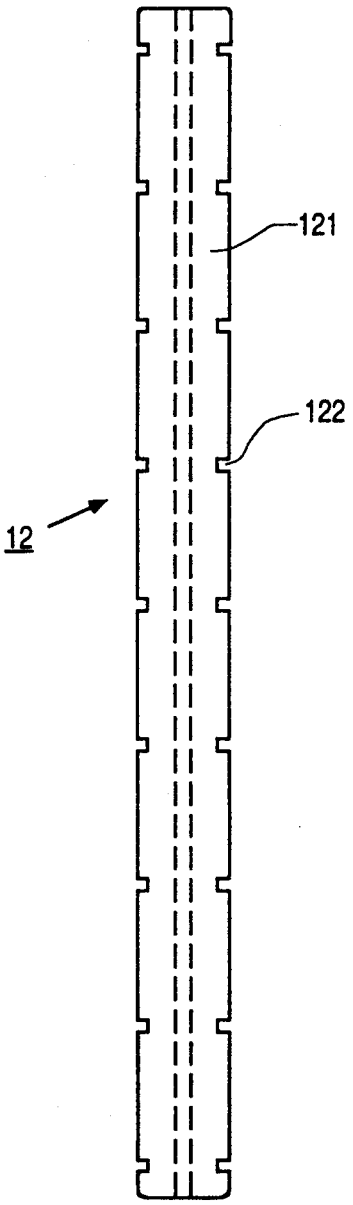
FIG. 2A is a top view.
Figure 2B:
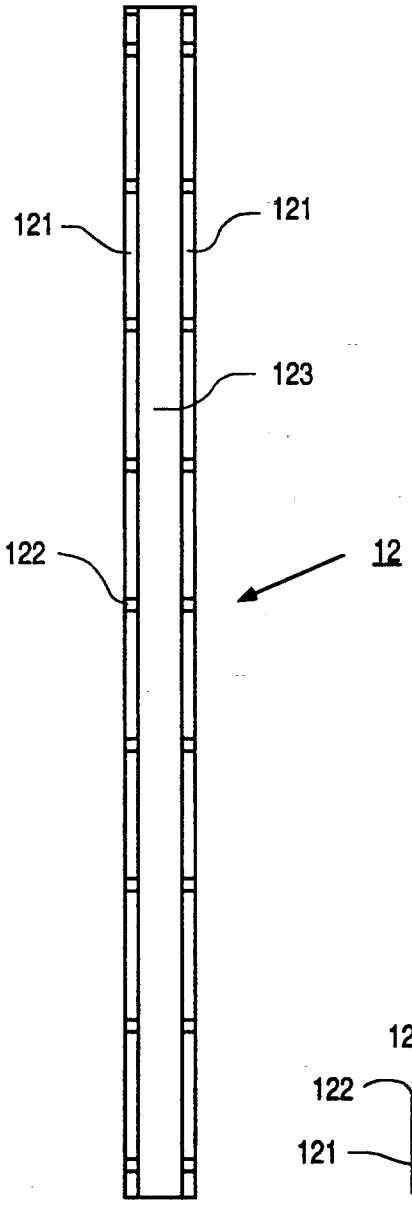
FIG. 2B is a side elevation.
Figure 2C:
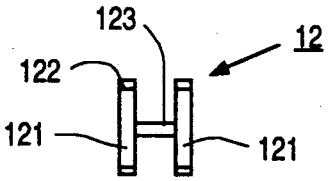
FIG. 2C is an end view showing an "H" cross section.
Figure 3:
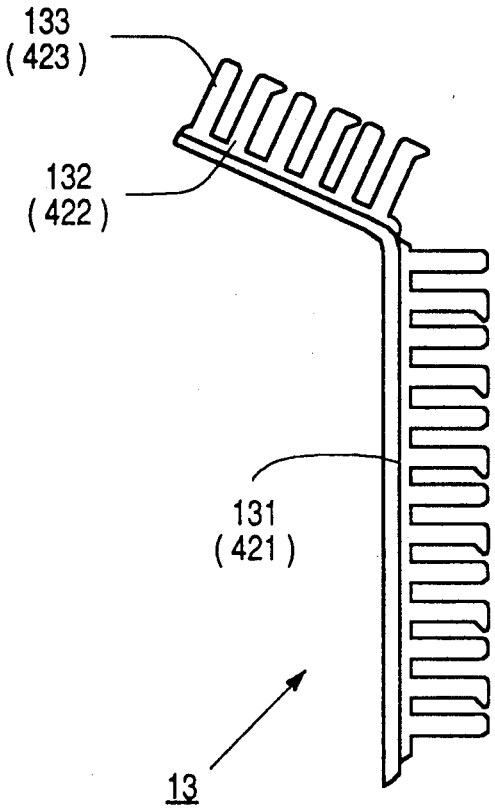
FIG. 3 depicts a rake type linkage means, single sided.
Figure 4:
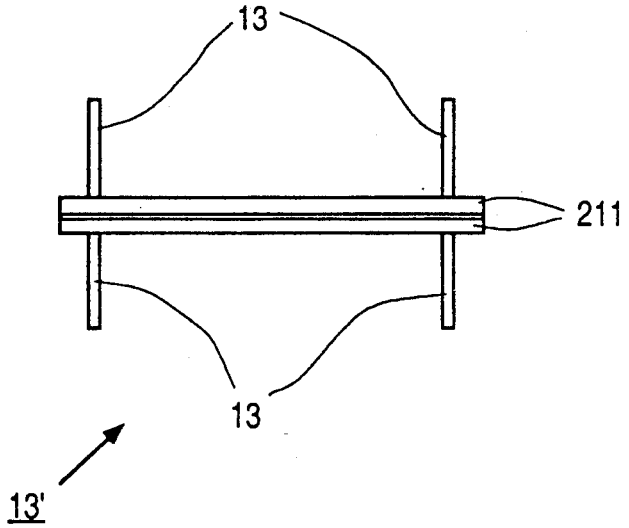
FIG. 4 depicts a top view of a double-sided, double decked rake type linkage means.
Figure 5:
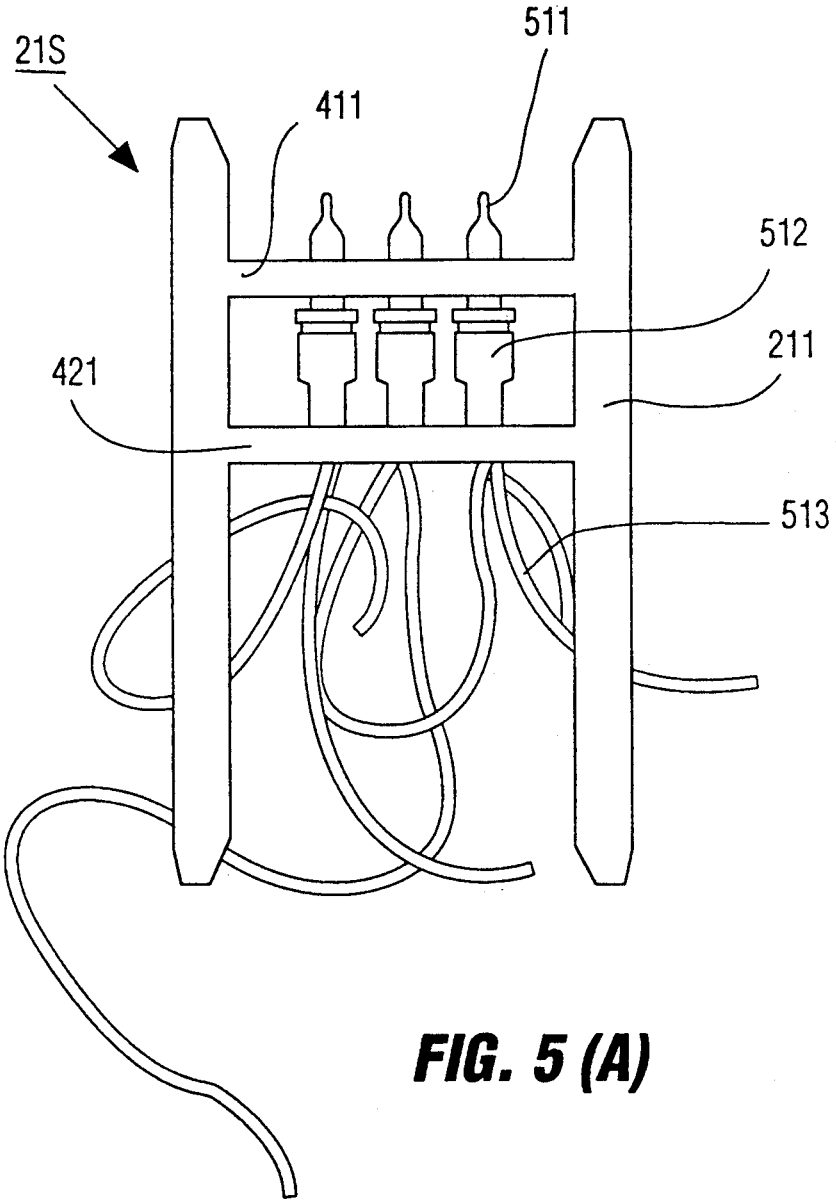
FIG. 5A and 5B are back elevations depicting gate type racks, both single sided, and FIG. 5B further illustrates such a rack with a notch on its post.
Figure 5:
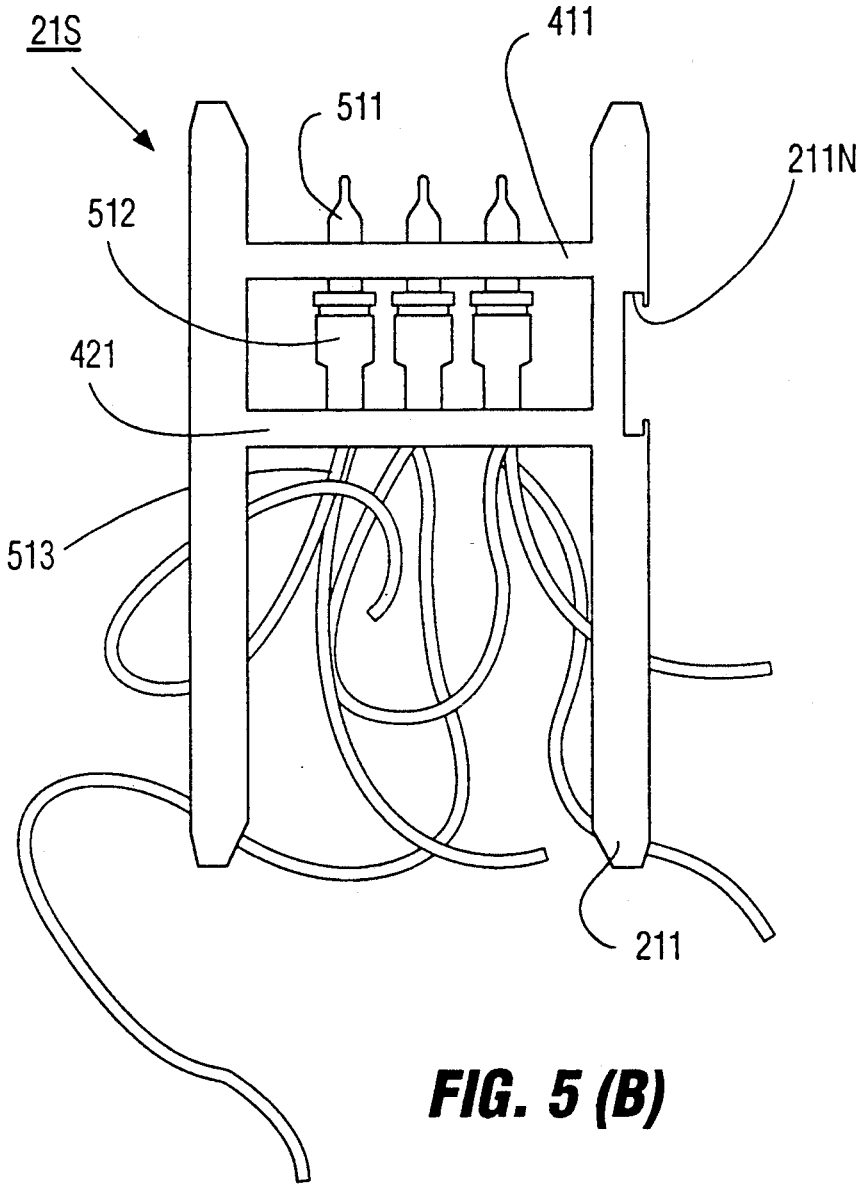
Figure 6:
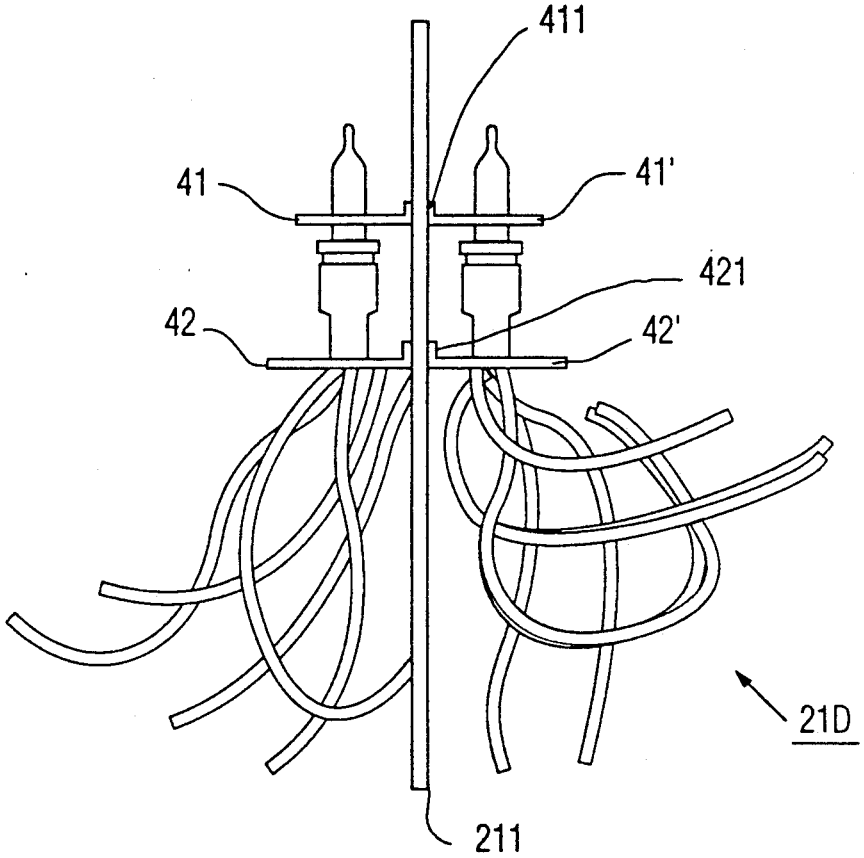
FIG. 6 is a side elevation showing a gate type rack, which is double-sided.
Figure 7B:
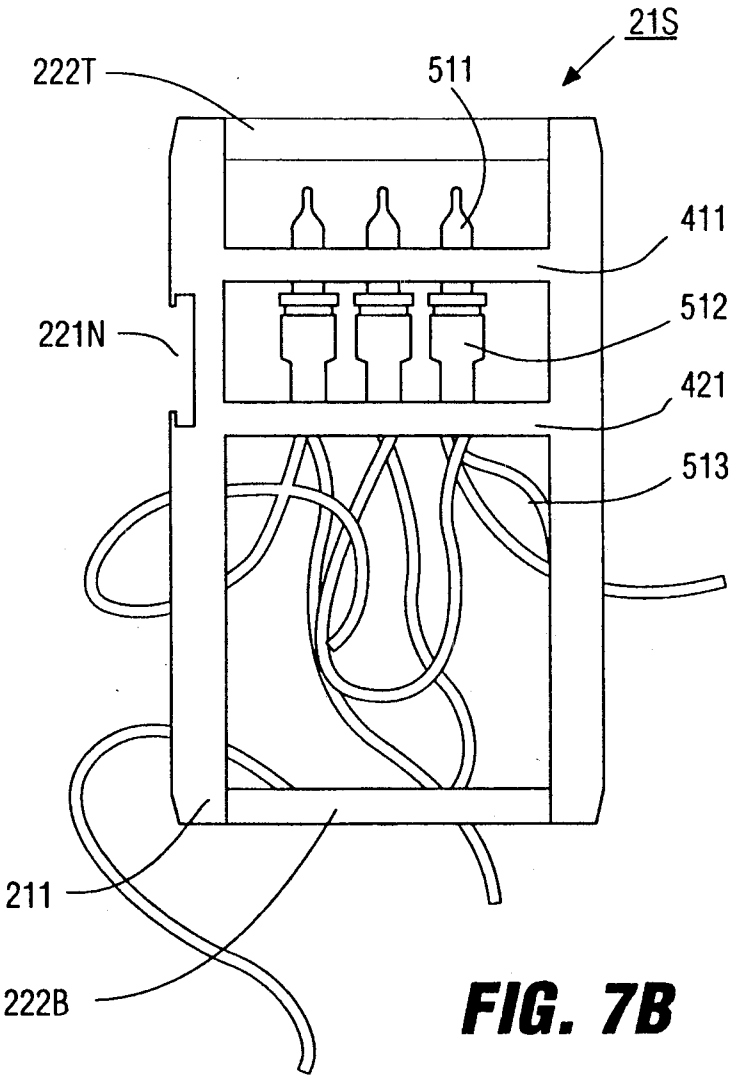
FIG. 7 is a back elevation of a pair of single sided frame type racks, showing a pair of mirror-imaged, notched posts.
Figure 7A:
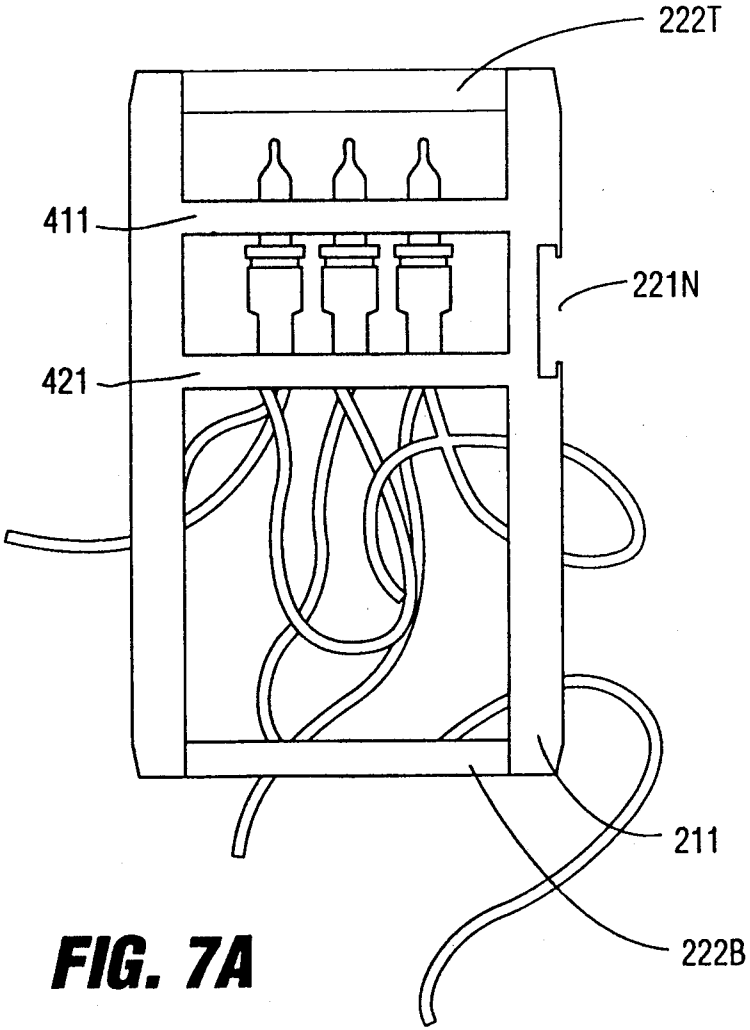
Figure 8:
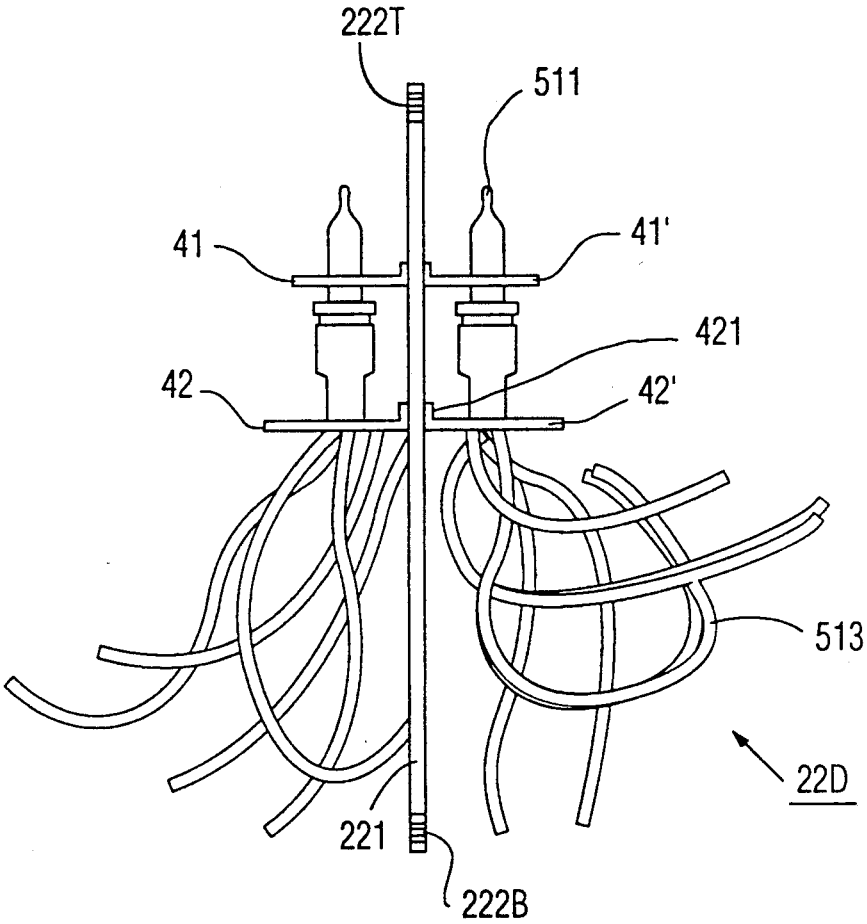
FIG. 8 is a side elevation showing a double-decked, double sided frame type rack.

| Component list | |
|---|---|
| 10 linkage means | |
| 11 stripe type | FIG. 1 |
| 111 spine | |
| 112 ribs | |
| 113 connecting slots | |
| 115 buckle head | |
| 116 linking slots | |
| 116' linking slots | |
| 12 beam type | |
| 121 girder | FIG. 2(A-C) |
| 122 notch | |
| 123 cross beam | |
| 13 rake type, single sided | FIG. 3 |
| 131 jointer (or cross member in rack) | |
| 132 claws | |
| 133 fingers | |
| 134 gap | |
| 13' rake type, doubled sided | FIG. 4 |
| 20 racks | |
| 21 gate type | |
| 21' gate type, limping | |
| 21S gate type with single sided rack | |
| 211 post | |
| 211N post with notch | FIG. 5(B) |
| 21D gate type with double sided rack | |
| | FIG. 6 |
| 22 frame type | |
| 22S frame type with single sided rack | FIG. 7 |
| 221 post | |
| 221N post with notch | |
| 222T cross bar | |
| 222B cross bar, bottom | |
| 22D frame type w/double sided rack | FIG. 8 |
| 30 Base | |
| 31 base, serpent type | FIG. 13(c) |
| 311 peak, double walled | |

-continued

Figure 9B:
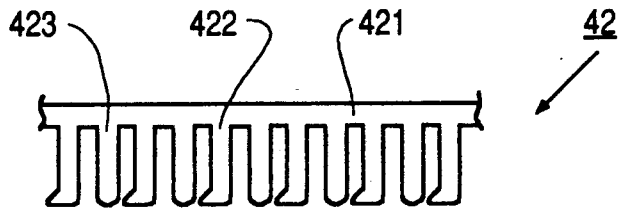
Figure 9A:
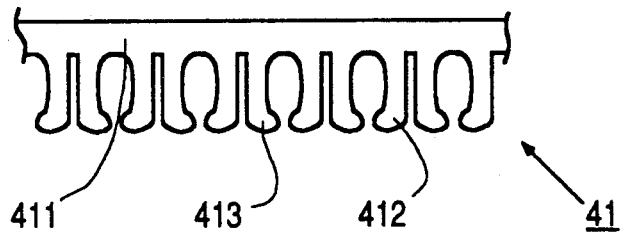
FIG. 9A shows a claw and finger type and FIG. 9B, a hug type.
Figure 10A:
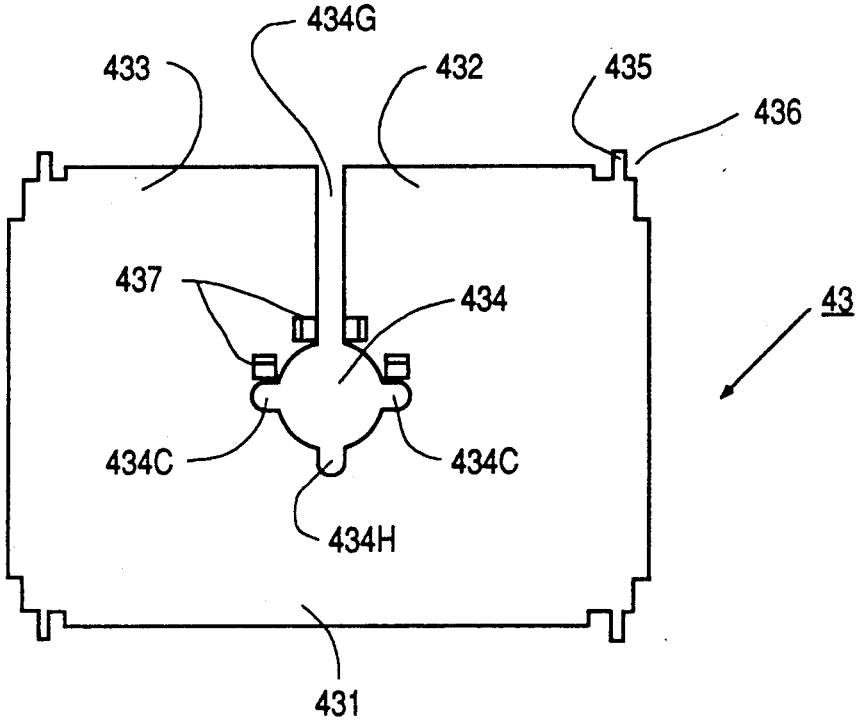
Figure 11A:
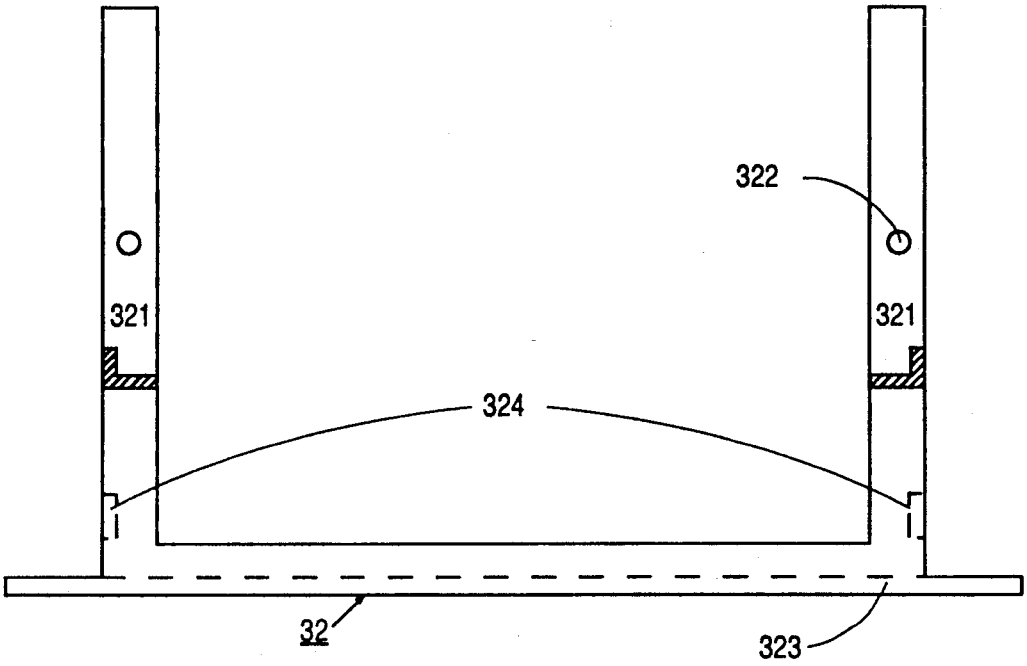
Figure 12B:
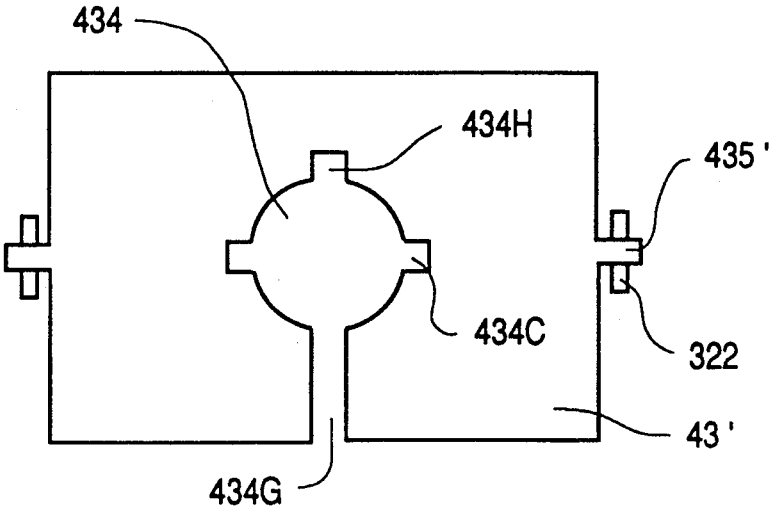
FIG. 12A and 12B depict respectively a front elevation and a top view of the assembled package using a plate type holding clamp.
Figure 12A:
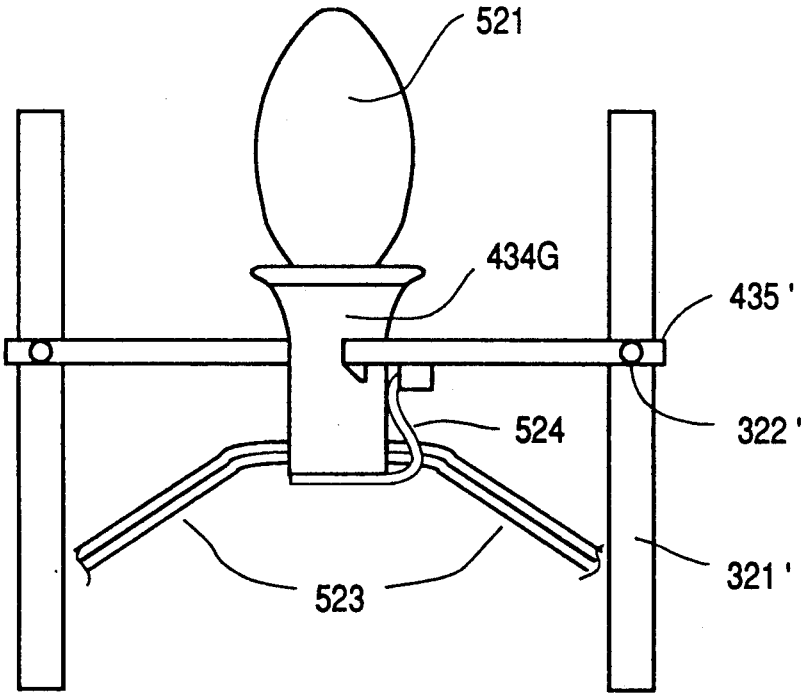
Figure 13B:
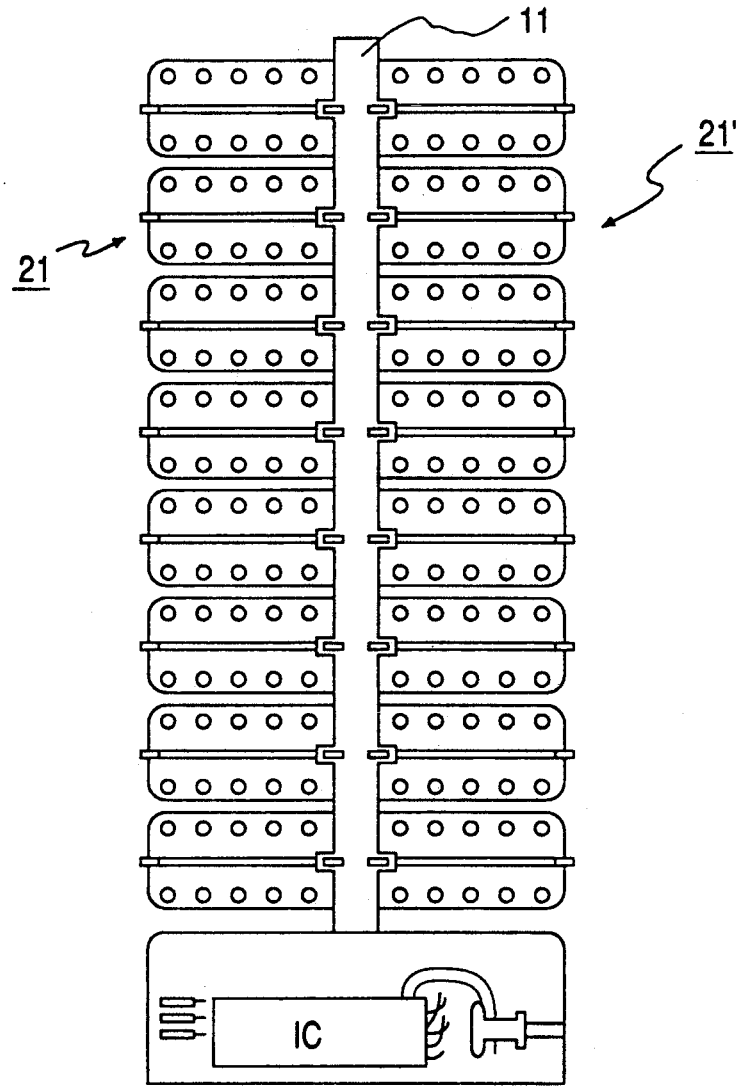
FIG. 13A and 13B depict respectively an end elevation, and a top view of the assembled package using stripe type linkage means with a gate type rack.
Figure 13A:
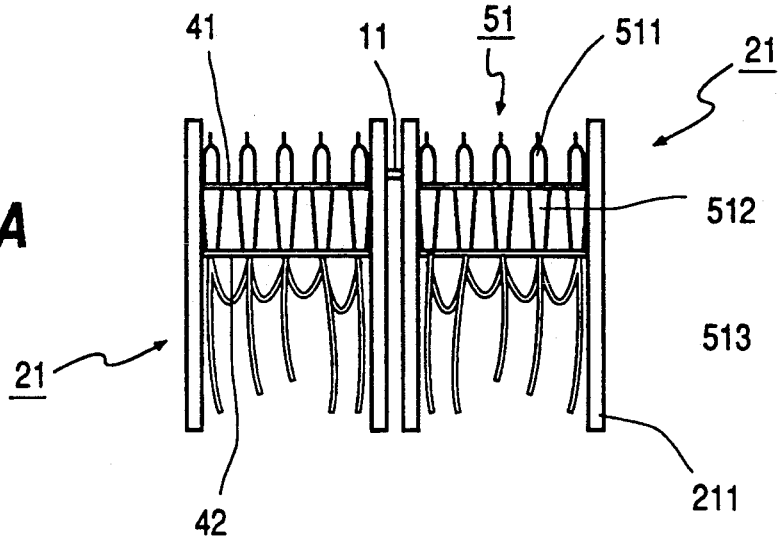
Figure 13:
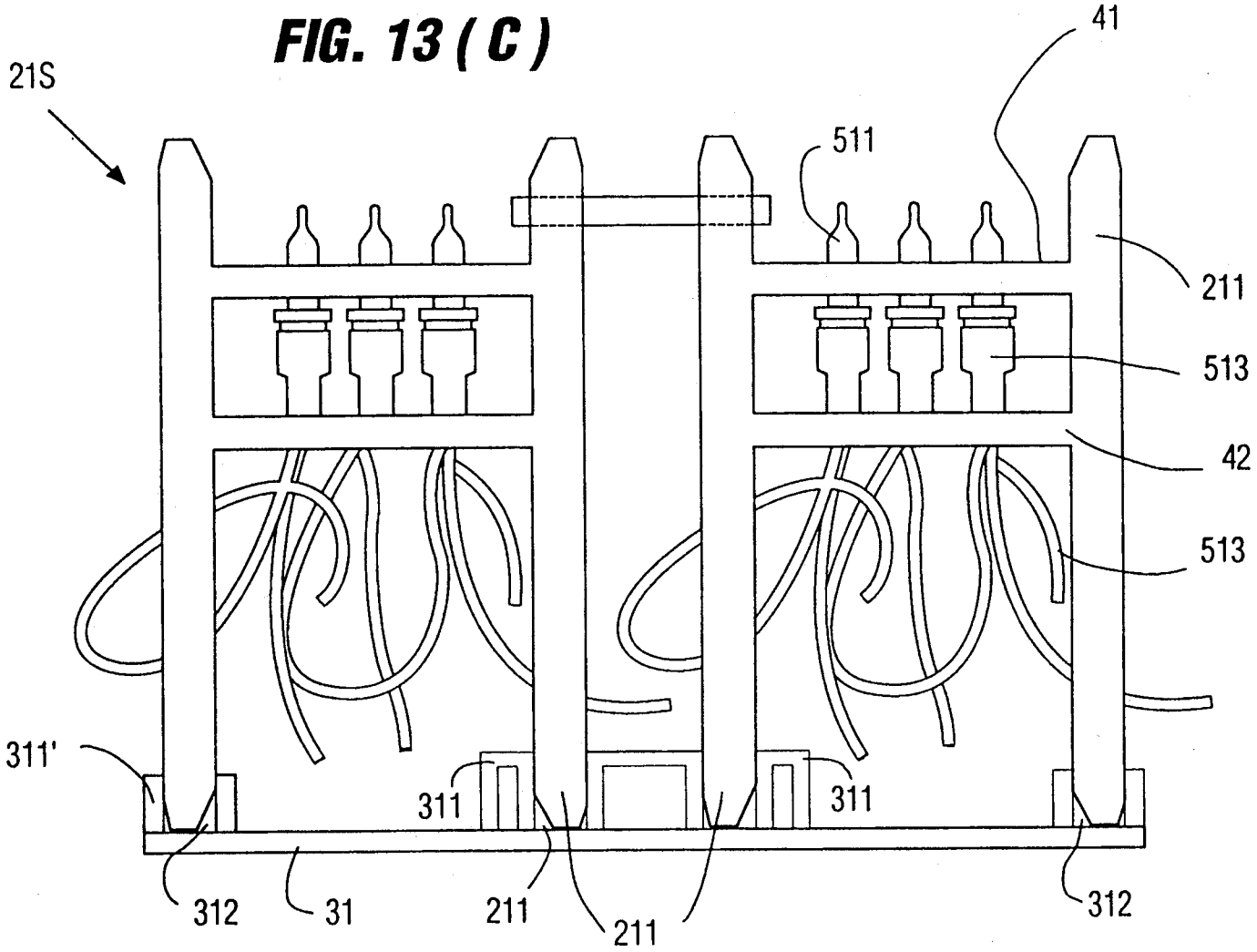
FIG. 13C is similar to FIG. 13A, wherein a gate type rack having a serpent-type base for support is shown.

| | |
|---|---|
| 311' peak, single walled | |
| 312 trough | |
| 32 base, plain type | FIG. 11(A) |
| 321 post | |
| 322 (322') clamping plate peg hole | |
| 323 longitudinal bar | |
| 324 cross bar | |
| 325 base fixing or interconnecting hole | |
| 40 holding clamps | |
| 41 hug type | FIG. 9(A) |
| 411 trunk (or cross member in rack) | |
| 412 right arm | |
| 413 left arm | |
| 42 claw and finger type | FIG. 9(B) |
| 421 jointer (131) (or cross member in rack) | |
| 422 claws (132) | |
| 423 fingers (133) | |
| 43 plate type | FIG. 10(A), (B) |
| 431 plate | |
| 432 clamping element, right | |
| 433 clamping element, left | |
| 434 socket holding opening | |
| 434C passage for conductors | |
| 434H passage for hook | |
| 434G gap | |
| 435 mounting peg | |
| 436 angle fitter | |
| 437 hook locator | |
| 50 lamp assembly | FIG. 13 |
| 51 smaller size | |
| 511 bulb | |
| 512 socket | |
| 513 wires | |
| 52 larger size | FIG. 12(A) |
| 521 shield (or bulb) | |
| 522 hood (or socket) | |
| 523 conductor | |
| 524 hook | |

Now referring to FIG. 1, a stripe type linkage means is shown. The wrist-watch-bond like stripe 11 is desirably made of flexible plastic material which is punched out from a sheet of suitable thickness. Stripe 11 comprises a spine 111 with ribs 112 projecting spacedly along two sides of the spine 111. Connecting slots 113 are provided on ribs 112 serving to receive gate type rack means 21 as explained below. At one end of the spine 111, buckle head 115 is provided with linking slots 116, 116' on it, while at the other end, tongue means (not shown) may be provided to link with slots 116, 116'.

In FIG. 2, an "H" beam type linkage is shown which is named because of its end view (FIG. 2C) which resembles, in cross-section the letter "H". Said beam has girders 121 disposed at two sides and joined by a cross beam 123. On the edge of each girder 121, equal spacedly disposed notches 122 are provided, with each pair of notches 122 (FIG. 2B), engaging a second type or frame type rack 22, which is also explained below.

FIG. 3 and 4 show respectively single-sided and double sided rake type linkages. In FIG. 4, it is disposed in two decks. The rake 13 is composed of a jointer 131 with pairs of claws 132 and fingers 133 or 133'. The rake type linkage 13 may in the meantime function as one type of holding clamp 40, i.e., claw and finger type clamp means 42. The above parts correspond to identical parts of clamp 42.

The jointer 131 is of resilient plastic material. It can be seen in FIG. 3. The jointer 131 is bent to a certain desired angle for the purpose, as illustrated below in FIG. 17B, of forming a polygonal linkage.

FIG. 4 shows two double decked rake type linkages 13 with their supporting posts disposed back-to-back to form a double sided, double deck rack 13'.

FIG. 5A shows a gate type rack 21S having two decks of cross members 411 and 421 disposed on a single side. The supporting posts 211 may have their end tips beveled or chamfered for easier insertion into the slots 113 of a stripe type linkage 11 (as shown in FIG. 1).

FIG. 5B is similar to FIG. 5A with the exception that the posts are plain ended and a notch 211N is shown on one post 211 for linking with H beam type linkage 12 (as shown in FIG. 2).

FIG. 6 shows a gate type rack 21D having two decks of cross members 411, 421 which will be described in detail below, disposed at the front side of the gate posts 211.

FIG. 7 shows a pair of frame type single sided racks 22S. In addition to top and bottom cross bars 222T and 222B, each has intermediate cross members 411, 421 just like those in the gate type rack 21, extending between the two posts which constitute the frame. One of the posts has a notch 221N on it, which serves to connect with an H beam type linkage. In FIG. 7, a pair of symmetrically disposed notched frames is shown in mirror-image relationship. An H beam is to be inserted between the notches.

FIG. 8 shows, in a side elevation, a frame 22D having double decked intermediate cross members 41, 41', 42, 42' disposed on both sides.

FIGS. 9 and 10 depict the fundamental elements, i.e. the holding clamp means for light bulbs in the package. The holding clamp means shown in FIG. 9 serves to hold smaller size bulbs with a self contained bulb base but with no separate lamp socket. A string of such lights may consist of up to hundreds of bulbs. The clamp means depicted in FIG. 10 serves to hold larger size bulbs having an individual shield and hood and, contained therein, bulbs with or without a socket.

The hug type clamping element 41 (FIG. 9B) is composed of a right arm 412 and left arm 413. The pair of arms 412, 413 extends on a trunk 411 to a desired length and may be cut in sections, usually of around five pairs. The bulb or upper portion of the small size lamp is thereby hugged in the gap between the arms, and the lower or lamp base portion is held by a claw-and-finger clamping means 42 (FIG. 9A). Therefore, when arranged in a rack, either gate or frame type, the two clamping means 41, 42 become intermediate cross members, and serve to maintain the lamp bulbs upright in the package. Hence, the hug type clamping element 41 for the bulb always lies above the claw and finger type 42, which receives the lamp base.

Figure 10B:
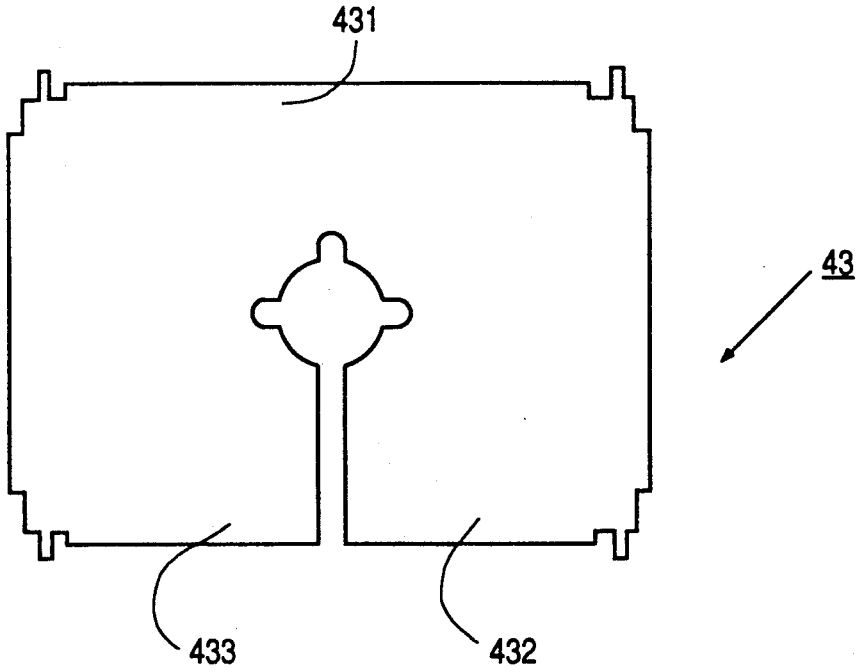

FIG. 10 depicts a further type of clamping means, namely, a plate type clamping means 43. FIG. 10B is a top view, and FIG. 10A is a bottom view. The clamping means 43 comprises a plate 431, having right and left clamping elements 432, 433 which form a socket holding opening 434 to receive a large size bulb having a shield, a hood and a hook at the base of the hood. It should be noted that FIG. 12 depicts an assembled package including plate type clamping means. Two conductors may enter the opening 434 of the plate type clamp 43 through two side passages 434C, and another passage 434H is for a hook. At the four corners of the plate 431, angle fitters 436 and pegs 435 are provided for mounting onto the angle type posts 321 (see FIG. 11) and through peg holes 322. The bottom view (FIG. 10A) of the plate will be further described below in connection with the discussion of FIG. 12.

Frame type racks may stand on their own bottom crossbar with considerable steadiness. Gate type racks require an auxiliary base for that purpose. A serpent type base 31, such as that shown in FIG. 13(*c*), is for gate type racks. The serpent type base actually takes the form of a wave having peaks and troughs. A base 31 having peaks 311 (or 311') and troughs 312 is shown, wherein peaks 311 are of the double walled type and peak 311' is single walled.

For plate type clamp means 43, a plain type base (see FIG. 11A and B) will suffice. Posts 321, having an angle section, stand at the four corners of the plate type clamp 43, and have peg holes 322 to accommodate the mounting pegs at the corners of the plates. Said base 32 is actually a composite member having posts and bars, which is composed of longitudinal bars 323 and cross bars 324. Holes 325 are disposed on base 32 for fixing the same or interconnecting with adjacent base-rack composites.

FIG. 12 A and B depict another form of rack and a plate type clamp. Instead of four corner angle posts 321, two plain posts 321' are provided with peg holes 322' to receive pegs 435' of the plate 43'. Referring to FIG. 10A, a bottom view of the plate type clamp 43, locators 437 are provided for confining the hook provided with a larger size bulb. Now referring again to FIG. 12(A), the bulb can be seen to have a shield on top, connected with a hooded socket thereunder. Two conductors extend from two sides and a hook attaches to the bottom of the hood.

Figure 11B:
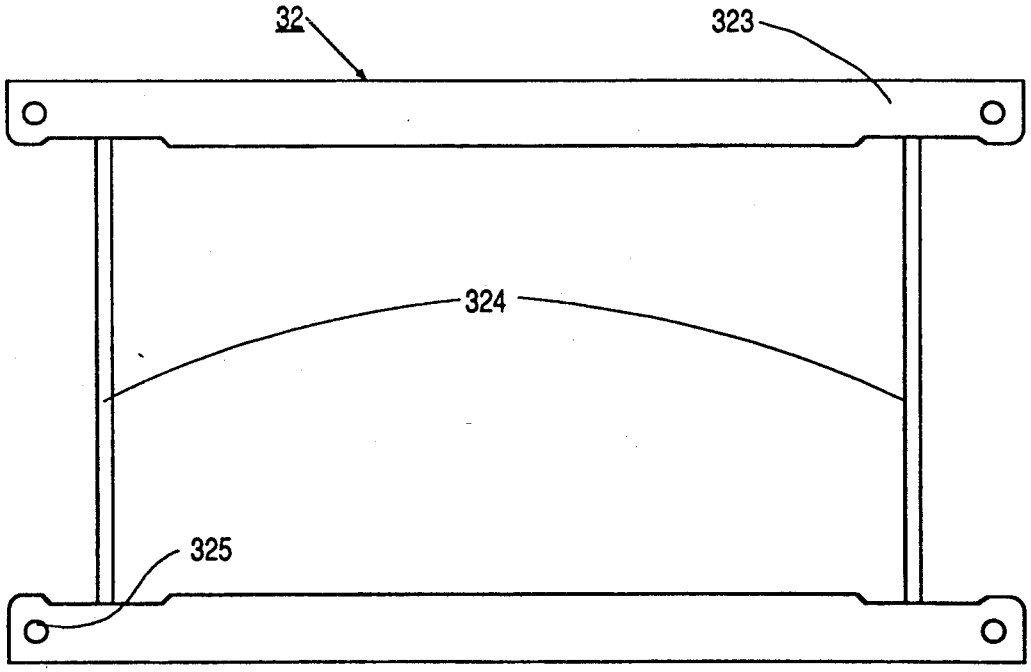

The embodiment of FIG. 12 can optionally be provided with a plain type base 32 (as shown in FIG. 11) or more preferably a serpent type base (not shown in the drawing). With the two supporting posts 321', it is more like a gate type rack.

FIG. 13A, 13B, 13C show a compact and orderly package using stripe type linkage 11 and double decked, double sided gate type racks 21. In the drawing, sixteen such racks 21 are used altogether to accommodate 160 pieces of string for small size decoration lamps 51. Bulbs 511 are held by hug type clamp means 41, and the socket is held by claw and finger type clamp means 42. In the top view (FIG. 13B) shown, space is reserved in the pack for IC means which may be required for programming the lighting sequence.

FIG. 13C shows an end elevation of the same assemblage with a serpent type base 31 provided under the gate posts 211. The base 31 is generally in serpent or wave form having troughs 312 and peaks 311, 311' provided. Peaks 311 are double walled and disposed in central rows, while peaks 311' are single walled and disposed along the sides of base 31. The double walled peaks 311 are disposed right under the posts. The stripe type linkage is applied on top of the posts.

Figure 14A:
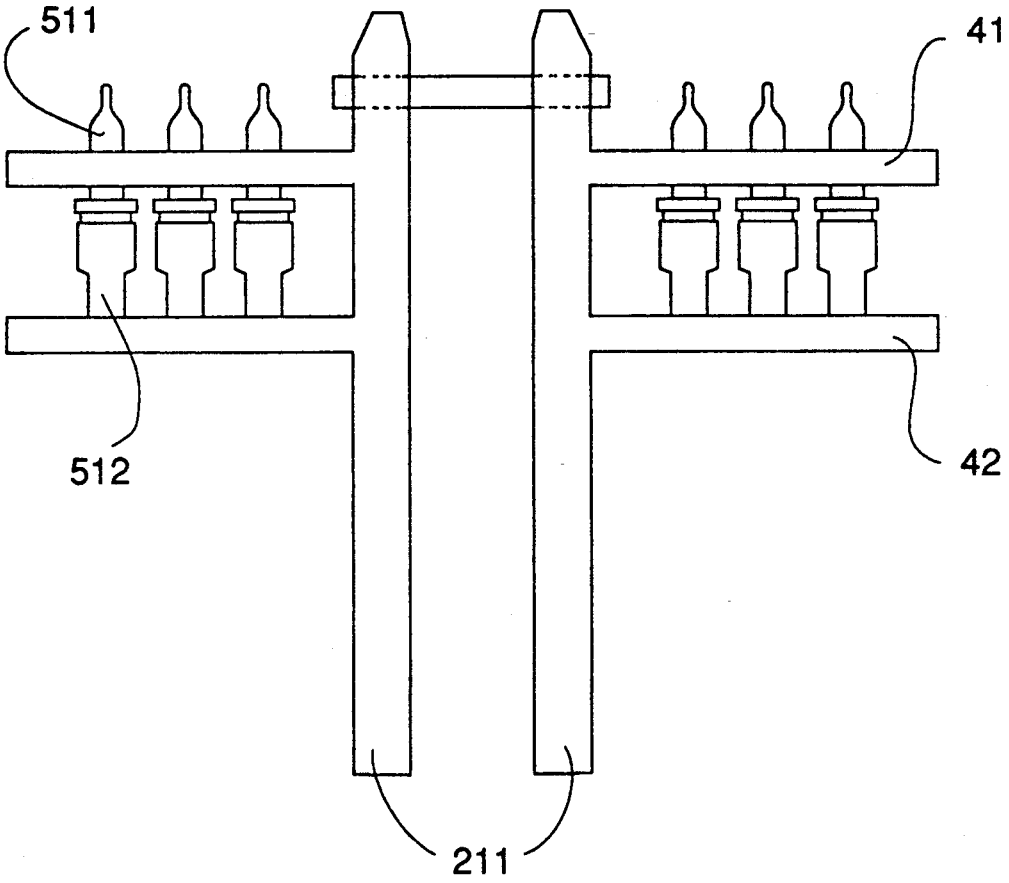
FIG. 14A, 14B and 14C depict respectively an end elevation, a top view, and a side elevation of the assembled package using stripe type linkage means, wherein a single posted gate rack (or limping gate), where one side of the rack is dangling, is shown.
Figure 14B:
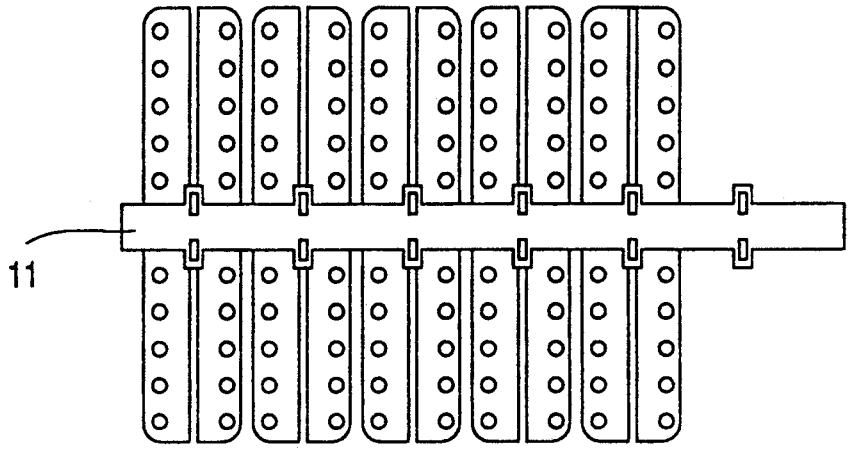
Figure 14C:
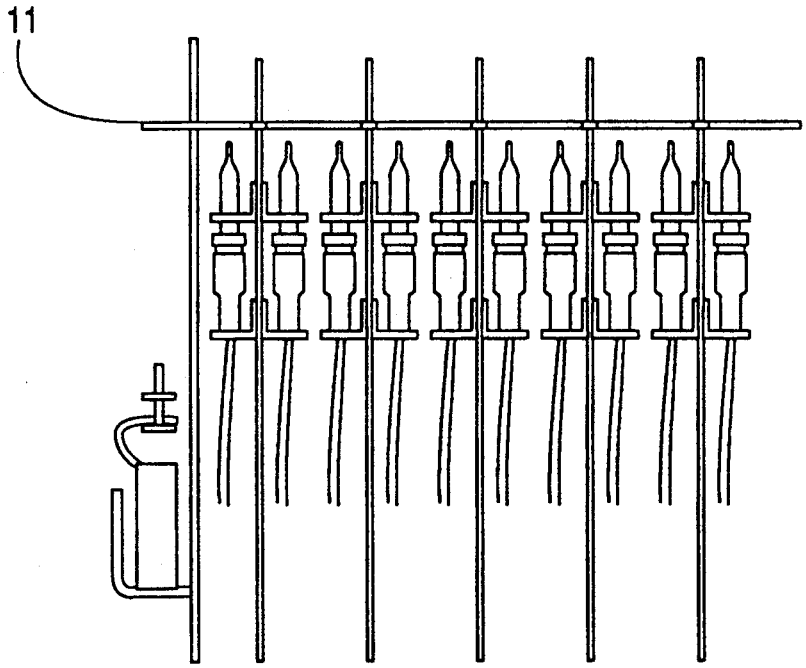

FIG. 14A, 14B and 14C depict an almost identical structure as FIG. 13, the only exception being that the outside posts constituting the gate type rack are omitted. Therefore, this may be called a limping gate 21'. In the clamp gangs 41, 42, the free ends of the cross bars are dangling.

Figure 15:
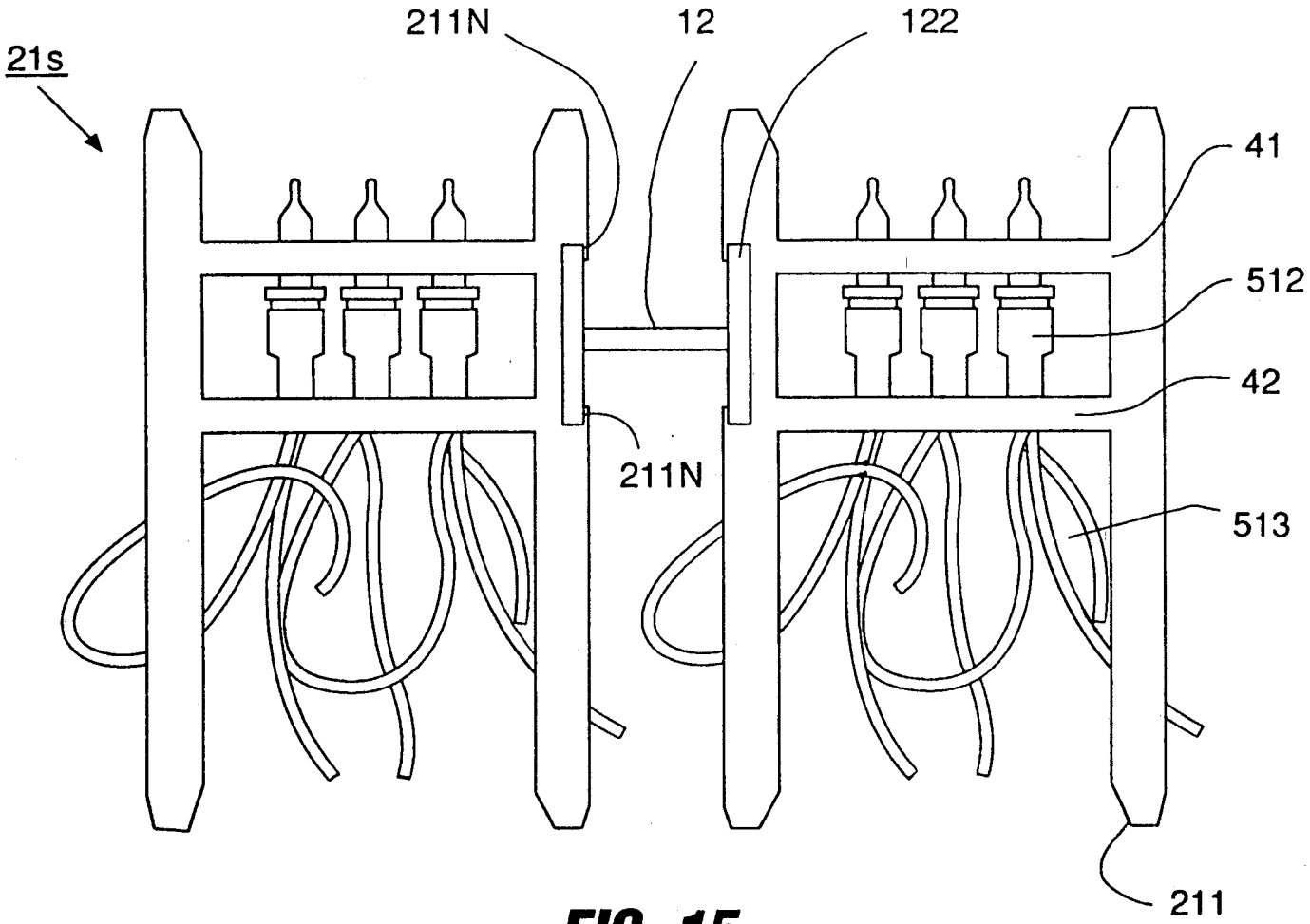
FIG. 15 is an end view of the assembled package using beam type linkage means, wherein the connected posts have notches.

FIG. 15 depicts the application of beam type linkage 12, wherein notch 122 on girder 121 of the H beam 12 mates with the notch 211N, of the gate post 211.

Figure 16A:
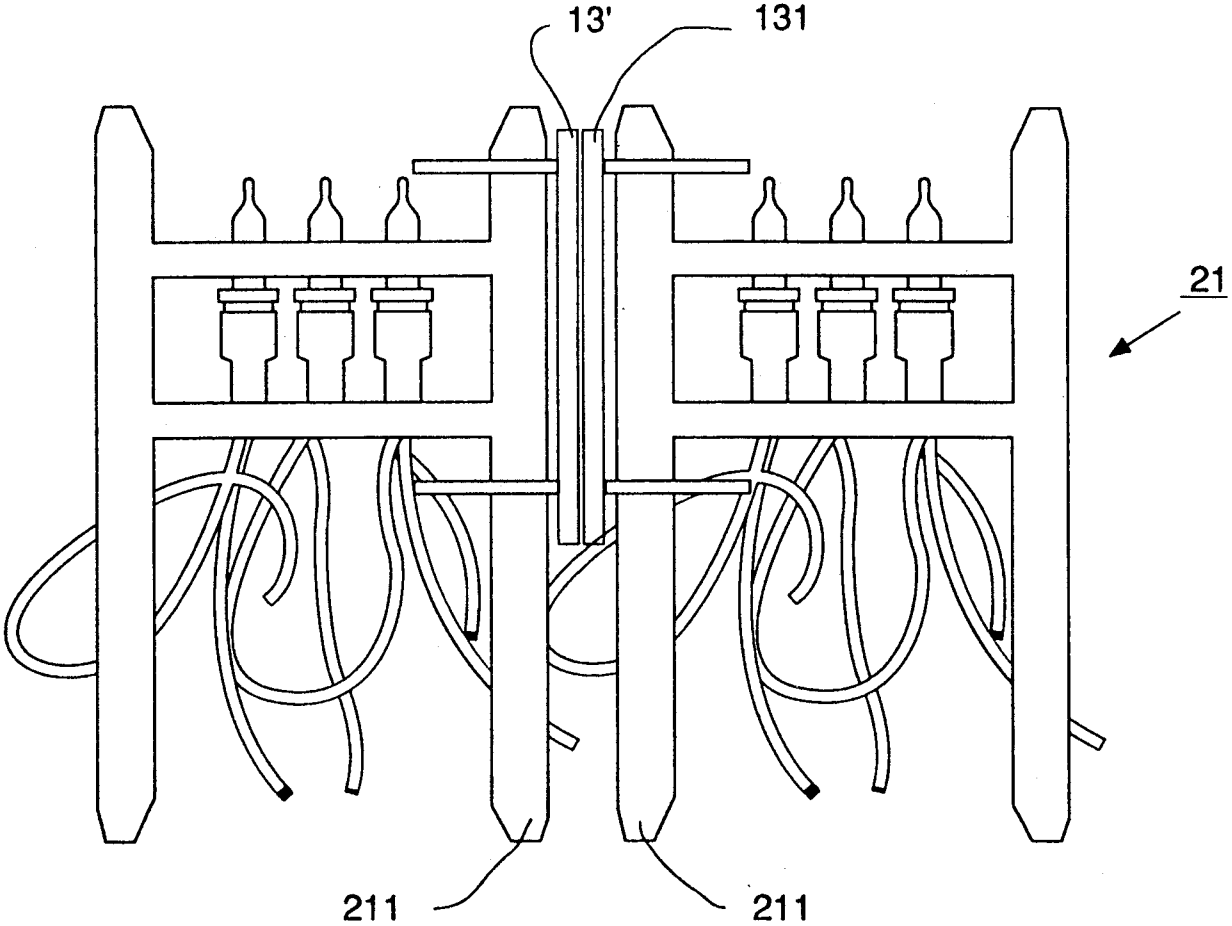
FIG. 16A and 16B depict respectively an end view and a top view of the assembled package using rake (or claw and finger) type linkage means.
Figure 16B:
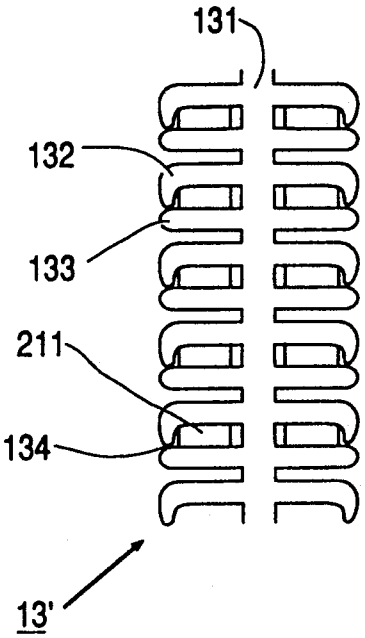

FIG. 16A depicts an assembly using rake type linkage means 13' which is shown in double sided formation and in double decks. In a top view, as shown in FIG. 16B, it can be clearly seen that rack post 211 is clamped in the gap 134 formed between claw 132 and finger 133.

Figure 17A:
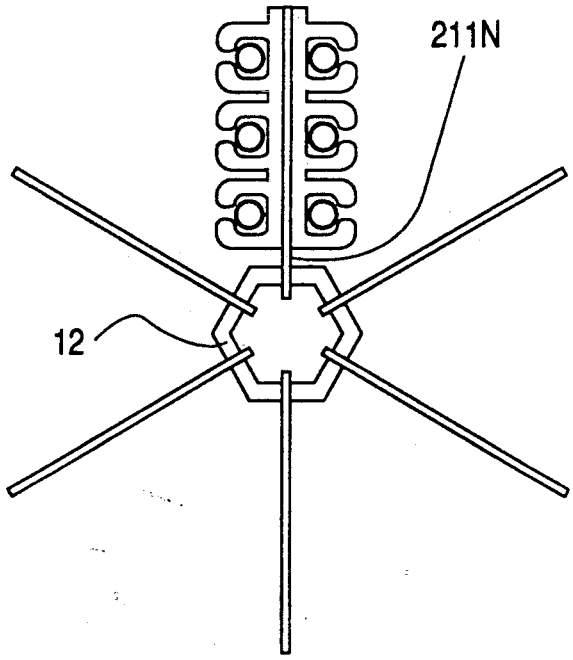
FIG. 17A and 17B depict respectively polygonal linkage means based on beam type and rake (or claw and finger) type linkage means.
Figure 17B:
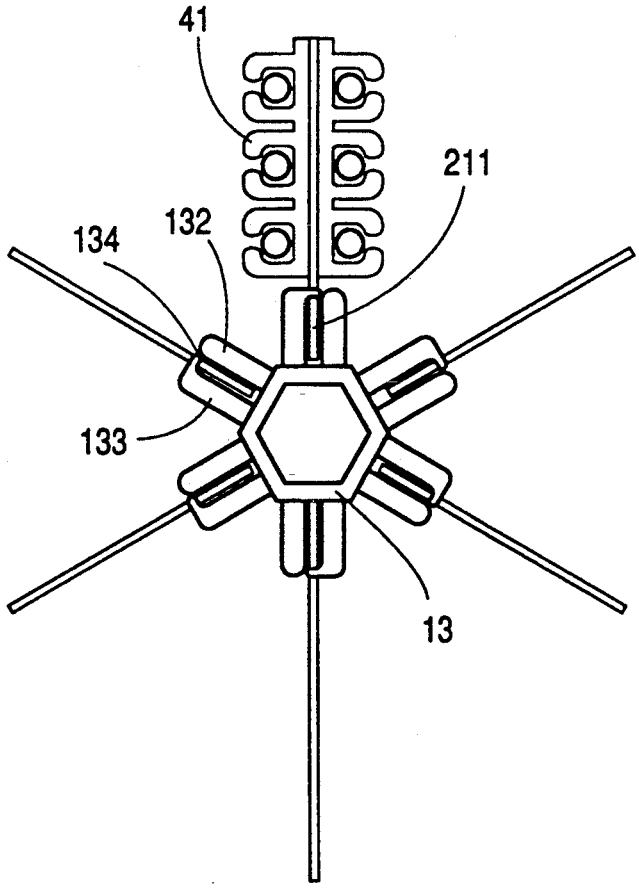

FIG. 17A and 17 B are examples showing the thermoplastic linkage members being bendable to form polygonal connectors as desired. FIG. 17A shows a hexagon formed with H beam 12 and posts 211 extending from each side of the polygon. In FIG. 17B, a hexagon is formed with a rake type linkage, and the racks extend radially from each side of the polygon.

This specification is explained by way of embodiments. Modifications and variations are possible to those skilled in the art without departure from the spirit of the invention, which is covered in the scope of the annexed claims.

We claim:

1. A packing device for light strings comprising: (a) clamp means for clamping at least one light; (b) rack means for supporting said clamp means; and (c) linkage means for linking a plurality of said rack means to form an orderly and compact package.

2. The packing device according to claim 1, wherein said clamp means comprises clamp means of a first form and a second form; said first form being hug type clamp means having right and left arms adapted to hold bulbs; and said second form being claw and finger type clamp means adapted to hold a socket, and wherein said rack means comprises an upper intermediate cross member and a lower intermediate cross member; a plurality of said hug type clamp means being arranged in a row on said upper intermediate cross member; and a plurality of said claw and finger type clamp means are arranged in a row on said lower intermediate cross member, said cross members each being connected to a pair of upright posts, whereby a gate type rack is formed.

3. The packing device according to claim 2, wherein said rack means further comprises a top cross member attached to each of said upright posts above said upper intermediate member, and a bottom cross member attached to each of said upright posts below said lower intermediate member, whereby a frame type rack is formed.

4. The packing device according to claim 2, wherein each one of said posts has an upper end and a lower end, said ends being beveled.

5. The packing device according to claim 2, further comprising a base, comprising peaks and troughs and wherein at least one of the peaks is single walled and at least one of the peaks is double walled, said base being adapted to receive in said troughs a lower end of each of said posts, whereby said packing device will stand upright.

6. The packing device according to claim 1, wherein the linkage means comprises a spine having a plurality of ribs extending in equally spaced relation from each side of said spine, said ribs having connecting slots formed therein, said connecting slots being adapted to receive said rack means, and an end of the spine being provided with a buckled head having a linking slot formed therein, whereby said spine may interconnect with another spine.

7. The packing device according to claim 1 wherein the linkage means comprises a pair of girders connected by a cross beam so that said linkage means has an H-shaped cross section, notches being formed spacedly along each edge of each of said girders; and wherein notches are defined in said rack means, said notches in said rack means and said notches along said girder edges being adapted to match with one another.

8. The packing device according to claim 1, wherein the linkage means comprises a rake type linkage means comprising two jointers, disposed in a double-deck relation; having a plurality of claw and finger pairs thereon.

9. The packing device according to claim 8, wherein aid rack means comprises at least one supporting post, the double decked linkage means is provided in front of each of said posts and a second one of said double decked linkage means is provided in back of the posts.

10. The packing device according to claim 1, wherein the linkage means are made of a flexible plastic material, said linkage means, being bent longitudinally into, a polygon, said rack means being attached to and extending radially from each side of the polygon.

11. The packing device according to claim 1, wherein the clamp means comprises plate type clamp means having a plate, having right and left clamping elements, a gap being defined by said right and left clamping elements, a socket holding opening being defined centrally in the plate.

12. The packing device according to claim 11, further comprising pegs disposed on two sides of the plate and said rack means comprises two upright posts, holes being formed in said posts, said holes being adapted to receive said pegs.

13. The packing device according to claim 11 or 12 wherein said right and left clamping elements each define one of two diametrical passages for conductor wires and said clamping elements define a passage for a hook opposite to said gap between said right and said left clamping elements, said plate further comprising a plurality of hook locaters disposed around the socket holding opening.

14. The packing device according to claim 2 or 3, wherein the ends of the cross members of the rack means are free.

15. The packing device according to claims 3 or 4, wherein in at least one of said posts a notch is formed.

16. The packing device according to claim 11, wherein said plate has four corners, and an angle fitter having a peg is provided at each of said corners. .

* * * * *